United States Patent [19]

Councell

[11] Patent Number: 4,499,858

[45] Date of Patent: Feb. 19, 1985

[54] FUEL BURNING ASSEMBLY

[76] Inventor: Graham D. Councell, 8242 Brookgreen Rd., Downey, Calif. 90240

[21] Appl. No.: 576,522

[22] Filed: Feb. 2, 1984

[51] Int. Cl.[3] ..... F22B 5/00

[52] U.S. Cl. ..... 122/14; 122/18; 122/19; 122/23; 122/235 P; 126/350 R; 431/168

[58] Field of Search ..... 122/10, 18, 14, 19, 122/23, 235 P; 126/350 R; 431/168

[56] References Cited

U.S. PATENT DOCUMENTS 1,953,090 4/1934 Vroom ..... 431/168 X 3,149,614 9/1964 Musat et al. ..... 122/235 P

*Primary Examiner*—Edward G. Favors

*Attorney, Agent, or Firm*—William C. Babcock

[57] ABSTRACT

An improved fuel burning assembly particularly adapted for use with a boiler having a fire box situated below an array of boiler tubes. The assembly discharges a number of spaced rotating streams of minute droplets of a flowable fuel both laterally and longitudinally into the fire box to intermix with a stream of air that is moving rearwardly therein. The fuel air mixture when burning blankets substantially all the boiler tubes with a sheet of flame. Due to such flame contacts substantially all of the boiler tubes are heated uniformly thereby, rather than only a portion of the boiler tubes being contacted by the flame as occurs in a boiler when a conventional burner assembly is used. As a result of the flame distribution and uniform heating of the boiler tubes, an increased thermal efficiency is attained in the operation of the boiler on which the burner assembly of the present invention is used.

4 Claims, 5 Drawing Figures

FIG. 1
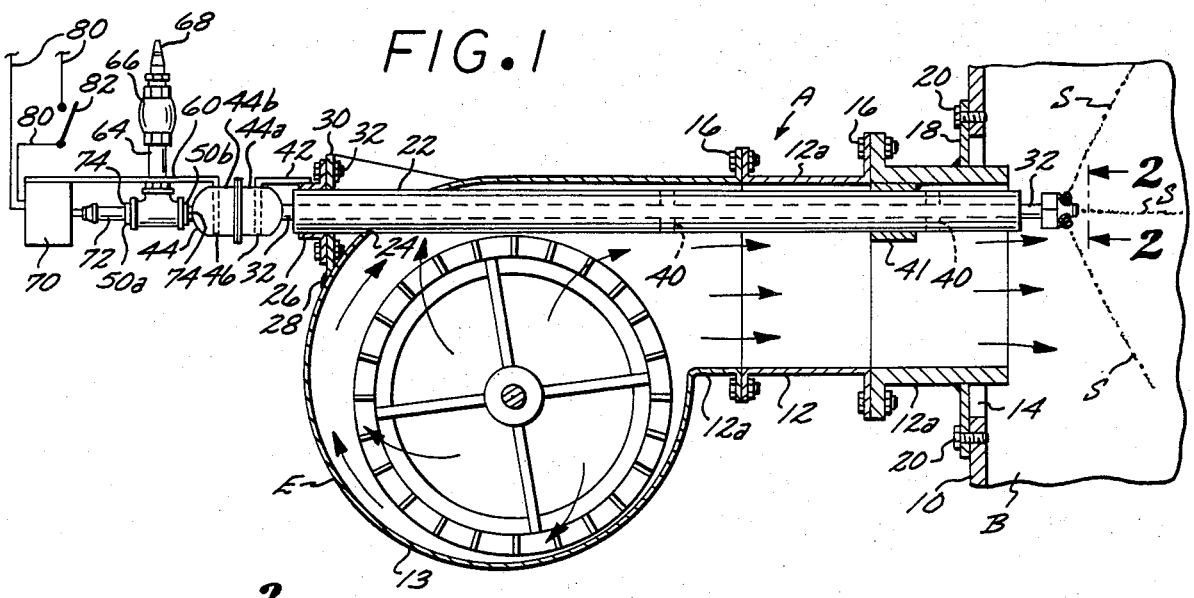
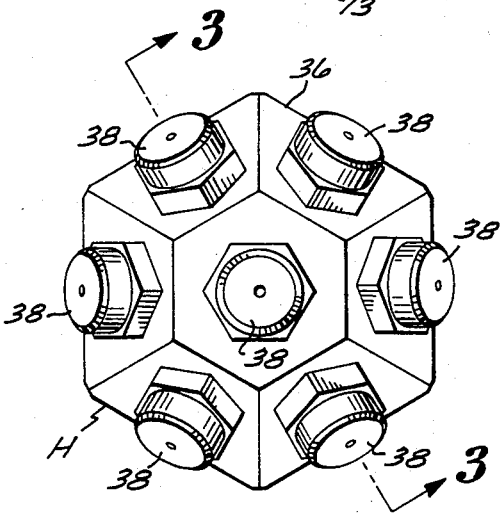
FIG. 2
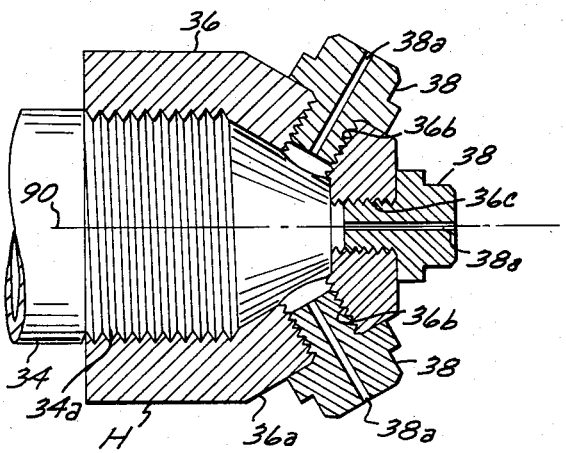
FIG. 3
FIG. 4
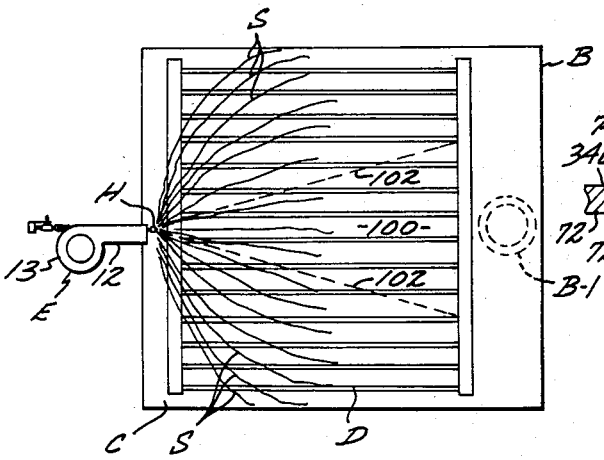
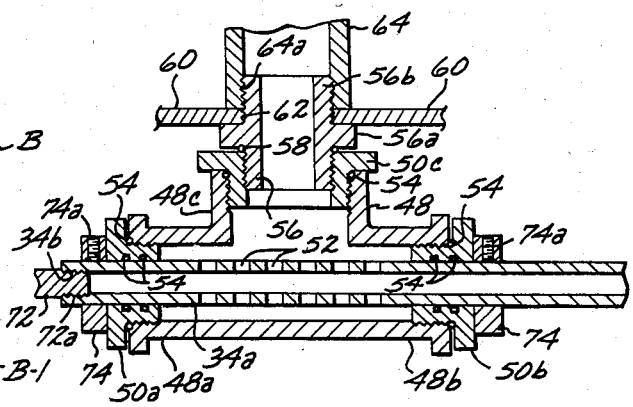
FIG. 5

FUEL BURNING ASSEMBLY

DESCRIPTION OF THE PRIOR ART

In prior art burner assemblies a flowable fuel is intermixed with a stream of air and injected into the fire box of the boiler to flow rearwardly therein. The rearwardly flowing stream of fuel and air fans out, but only the rearwardly disposed portion of the boiler tube are heated by direct contact with the flame resulting from the fuel air mixture.

The major part of the boiler tube located on the sides of the array of tubes are heated by radiation from the refractory side walls of the fire box when prior art boiler burner assemblies are used. Due to this prior art method of heating an array of boiler tubes, a substantial portion of the heat content of the rearwardly having stream of burning fuel is not transferred to the boiler tube, but is discharged through the stack of the boiler to the ambient atmosphere and serves no useful purpose.

A major object of the present invention is to provide an improved fuel air mixture burning assembly that substantially overcomes the operational deficiencies of prior art devices of this nature, and in so doing increases the thermal efficiency of the boiler on which it is used.

Another object of the invention is to supply a burner assembly that so distributes a rearwardly moving stream of fuel and air in the fire box of a boiler that substantially all of the boiler tubes are blanketed in a sheet of flame and uniformly heated as a result thereof.

Yet another object of the invention is to generate a number of laterally moving streams of finely divided droplets of flowable fuel, which streams also rotate about an axis parallel to the direction of flow of a current of air with which they intermix in a fire box of a boiler, and the combustion of the resulting fuel air mixture increasing the thermal effeciency of the boiler due to substantially all the boiler tubes being heated to a substantially uniform temperature.

These and other objects and advantages of the invention will become apparent from the following description of a preferred form thereof.

SUMMARY OF THE INVENTION

The present invention is used in conjunction with a boiler having a refractory line fire box situated below an array of boiler tubes. A power driven blower that includes a housing is provided, which blower has a tube extending therefrom to an opening in the forward portion of the fire box. In a conventional prior art boiler, the tube will have means for injecting fuel therein to mix with the stream of air discharged into the boiler. If the present invention is used on an existing installation of this type, the fuel injecting means may be removed as it will no longer be needed.

In the present invention an elongate tubular member is provided that is longitudinally disposed in the tube extending from the blower into the fire box, with the tubular member having a forward end adjacent the rearward wall of the fire box. A hollow head is mounted on the forward end of the tubular member and the head supports a number of circumferentially spaced and angularly disposed nozzles, each of which nozzles is adapted to discharge a stream of minute droplets of fuel therefrom. The streams of fuel so discharging are directed both laterally and longitudinally within the fire box to intermix with a forwardly moving stream of air from the tube that is connected to the blower.

The rearward end of the tubular member is sealed and slowly rotated by a power means. The tubular member has an apertured section situated within a tubular tee fitting to which a pressurized flowable fuel is supplied. Fuel flows forwardly through the tubular member to discharge from the nozzles. The streams of minute droplets of fuel discharging from the nozzle when mixed with the forwardly moving stream of air in the fire box and ignited results in a flame that substantially blankets all the boiler tube surfaces and heats the tubes and refractory lining of the fire box to a substantially uniform temperature. Due to this uniform heating of the boiler tubes and the walls of the fire box, the thermal effeciency of the boiler is substantially improved over the operation attained when prior art burner assemblies are used.

BRIEF DESCRIPTION OF THE DRAWINGS

FIG. 1 is a longitudinal cross sectional view of the invention;

FIG. 2 is a front elevational view of the nozzle supporting head taken on the line 2—2 of FIG. 1;

FIG. 3 is a transverse cross sectional view of the nozzle supporting head taken on the line 3—3 of FIG. 2;

FIG. 4 is a top plan view of the invention operatively associated with a boiler having a fire box and a number of parallel, laterally spaced boiler tubes situated adjacent thereto which tubes have the major portions of the surfaces thereof contacted by a flame from the present invention and the area covered by the flame of a prior art burner assembly being shown in phantom line within the fire box; and FIG. 5 is an enlarged longitudinal cross sectional view of the tubuler tee assembly used in supplying flowable fuel to the elongate member that supports the power head having the fuel droplet forming nozzles mounted thereon.

DESCRIPTION OF THE PREFERRED EMBODIMENT

The burner assembly A of the present invention is preferably used in conjunction with a boiler B that has a refractory lined fire box C below a number of parallel, laterally spaced boiler tubes D. Boiler B has a stock B-1. The fire box has a rearward wall 10. A power driven blower E is provided that includes a housing 13 in which an impeller 15 is disposed. The housing 13 has an air discharge tube 12 extending forwardly therefrom as shown in FIG. 1, with the tube extending through an opening 14 in the wall 10. The air discharge tube 12 is illustrated as being formed by a number of flanged sections 12*a* that are connected by bolts 16. A transverse plate 18 is secured to the most forwardly disposed one of the sections 12*a*. The plate 18 is secured to the wall 10 by bolts 20 as illustrated in FIG. 1.

An elongate tubular shell 22 extends forwardly through an opening 24 in the housing 13 and then proceeds through the upper portion of the tube 12 to terminate slightly forward of the wall 10. The rearward end of the tubular shell 22 has a flange defining fitment 26 secured thereto that is in abutting contact with a vertically extending plate 30 that is secured to the housing 13 by a weld 28. The fitment 26 is secured to the plate 30 by bolts 32 as illustrated in FIG. 1.

An elongate tubular member 34 extends longitudinally through the tubular shell 22 as shown in FIG. 1, with the tubular member having an externally threaded forward end 34*a*. A hollow internally threaded head H is provided as shown in FIG. 3 that engages the end 34*a*. The head H is defined by a cup shaped body 36 that has a frusto-conical forward portion 36*a* in which a number of circumferentially spaced, angularly disposed tapped bores 36*b* are formed, as well as a longitudinally disposed tapped bore 36*c*.

A number of externally threaded nozzles 38 are provided that engage the tapped bores 36*b* and 36*c*, with each of the nozzles having a longitudinal passage 38*a* therein. When fluid fuel under pressure is discharged through the passages 38*a* it is transformed into a stream of minute droplets S. The tubular shell 22 has a number of bearings 40 situated therein that rotatably support the tubular member 34. The shell 22 is held in a fixed position in tube 12 by a conventional support 41. An arm 42 extends rearwardly from the flange defining fitment 26 and on the rearward end supports an enclosure structure 44 in which a pair of bearings 46 are disposed that rotatably support the tubular member 34. The enclosure 44 includes a pair of flanged cup shaped hollow bodies 44*a* and 44*b* that are removably held together by conventional means (not shown). The forward hollow body 44*a* has the arm 42 secured thereto.

Situated rearwardly of the enclosure structure 44 is a tubular tee 48 that includes first, second and third legs 48*a*, 48*b* and 48*c*, with the first and second legs 48*a* and 48*b* being axially aligned. The legs 48*a*, 48*b* and 48*c* are internally threaded and are engaged by first, second and third externally threaded bushings 50*a*, 50*b* and 50*c* as shown in FIG. 5.

The tubular member 34 extends rearwardly through the tubular tee 48 as shown in FIG. 5. A section 34*a* of the tubular member 34 within the tubular tee 48 has a number of spaced aperatures 52 therein. The bushings 50*a* and 50*b* support sealing rings 54 within the interior thereof that rotatably seal with the external surface of the tubular member 34 as shown in FIG. 5. The bushings 50*a*, 50*b* and 50*c* when tightened on the legs 48*a*, 48*b* and 48*c* force resilient sealing rings 54 into pressure sealing contact with the legs as shown in FIG. 5. The third bushing 50*c* is illustrated in FIG. 5 as being internally threaded and engaged by a tubular member 56 that has an enlarged wrench engageable central portion 56*a* and an upper externally threaded end 56*b*. A resilient sealing ring 58 effects a seal between the central portion 56*a* and the upper end of third leg 48*c*.

An arm 60 extends rearwardly from the enclosure portion 44*b*, which arm has an opening 62 therein through which the threaded end portion 56*b* extends upwardly. A vertically extending tube 64 has a lower internally threaded end 64*a* in engagement with the threaded end portion 56*b* and in abutting contact with arm 60. The tube 64 extends to a fuel control valve 66, that has a conduit 68 extending therefrom to a pressurized source of fluid fuel (not shown).

The arm 60 in addition to supporting the tee 48 also supports a source of rotational power which is illustrated as a conventional geared down electric motor 70 that has a drive shaft 72. The drive shaft 72 has an externally threaded end portion 72*a* that engages a tapped rearward end 34*b* of the tubular member 34, and seals the rearward end.

The tubular member 34 has two collars 74 secured thereto by set screws 74*a*, which collars are located adjacent the first and second bushings 50*a* and 50*b* as may be seen in FIG. 5. The collars 74 prevent the tubular member 34 from moving longitudinally relative to the tubular tee 48.

The electric motor 70 or other source of rotational power is geared down to preferably rotate the drive shaft 72, tubular member 34, and head H at between 15 and 25 revolutions per minute. Electric power is supplied to motor 70 through a pair of electrical conductors 80, one of which has a switch 82 therein that is used to control operation of motor 70.

The use of the invention is extremely simple. The switch 82 is placed in a closed position to energize the motor 70 and the blower E is actuated by means (not shown). The valve 66 is now opened to allow oil to flow into the interior of the tee 48. Oil entering the tee 48 flows through the apertures 52 into the tubular member 34 to flow longitudinally through the latter to discharge as streams S from the nozzles 38.

The streams S of minute droplets of oil as shown in FIG. 4 discharge laterally and longitudinally from the nozzles 38, which nozzles rotate around the axis of rotation 90 of head H. The streams S discharge into a current of air flowing forwardly in the fire box C. The fuel air mixture, resulting from the intermixing of the droplets of fuel with the air stream, when ignited blanket substantially all of the surface portions of the boiler tubes D with a blanket of flames as may be seen in FIG. 4, and the flame also contacting the interior surface of the fire box C. Heat from the interior surface of the fire box is radiated to heat the boiler tubes.

In FIG. 4, a triangular area 100 between a pair of phantom lines 102 is shown, which area indicates the part of the boiler tubes D that would be heated by flame contact when a prior art burner is used. From a comparision of the portions of the boiler tubes D heated by flame contact with the present invention relative to the portion heated by a prior art burner, it will be evident that the present invention substantially increases the thermal effeciency of the boiler.

The use and operation of the present invention has been described previously in detail and need not be repeated.

What is claimed is:

1. In a boiler that includes a fire box having a rearward wall that has an opening therein; a plurality of boiler tubes disposed above said fire box; a power driven blower that includes a housing that has a pressurized air discharge opening from which a tube extends to said opening in said rearward wall to discharge a current of air into said fire box; a source of pressurized flowable fuel, the combination with said boiler of a burner assembly that substantially blankets all of said boiler tubes with a sheet of flame when said fuel is burned, said burner assembly including:

a. a low speed rotational power source that includes a drive shaft, said rotational power source situated rearwardly of said housing;

b. a tubular tee that has first, second and third legs, said tee situated between said drive shaft and housing, said first and second legs axially aligned with said drive shaft;

c. an elongate tubular member that is sealingly connected to said drive shaft and rotated thereby, said tubular member extending through said first and second legs, an opening in said housing, and longitudinally through said tube to terminate in a forward end in said fire box, with said tubular member having an apertured section within said tubular tee;

d. first means for conducting said pressurized flowable fuel from said source to said third leg, with said fuel entering said tubular member through said apertured section; and e. second means on said forward end of said tubular member that rotate therewith for discharging said pressurized fuel therefrom as a plurality of longitudinally and laterally moving rotating streams that intermix with said current of air, with the mixture of fuel and air when burning providing said shaft of flame.

2. A burner assembly as defined in claim 1 in which said second means includes:

f. a hollow head mounted on said forward end of said tubular member, said head having a plurality of spaced, tapped, transverse bores therein; and g. a plurality of externally threaded nozzles that removably engage said tapped bores, with each of said nozzles being of a type that transforms a fuel when the latter is a liquid into a stream of minute droplets.

3. A burner assembly as defined in claim 1 that in addition includes:

f. bearing means for rotatably supporting said tubular member in said tube.

4. A burner assembly as defined in claim 1 that in addition includes:

f. sealing means operatively associated with said tubular tee that pressure contacts said tubular member to prevent escape of said fuel from said first and second legs.

* * * * *